United States Patent [19]

Ohara et al.

[11] Patent Number: 5,069,141

[45] Date of Patent: Dec. 3, 1991

[54] OVERHEAD CONVEYOR WHICH PROVIDES INCREASED REACTIVE FORCE AND TRACTION TO DRIVE WHEEL ON ASCENDING RAIL SECTIONS

[75] Inventors: Osamu Ohara; Hiroshi Takata; Hiroshi Kawashima, all of Iwata, Japan

[73] Assignee: Yamaha Hatsudoki Kabushiki Kaisha, Iwata, Japan

[21] Appl. No.: 391,476

[22] Filed: Aug. 9, 1989

[30] Foreign Application Priority Data

Aug. 10, 1988 [JP] Japan ..... 63-199721

[51] Int. Cl.[5] ..... B61C 13/04

[52] U.S. Cl. ..... 105/30; 104/93; 105/73; 105/152

[58] Field of Search ..... 104/93; 105/30, 32, 105/73, 75, 82, 152, 209

[56] References Cited

U.S. PATENT DOCUMENTS

| | | | |
|---|---|---|---|
| 1,809,448 | 6/1931 | Koster et al. | 104/93 |
| 2,655,871 | 10/1953 | Mazzola | 105/30 |
| 3,074,354 | 1/1963 | Wakkila | 104/93 |
| 3,192,872 | 7/1965 | Parent | 104/93 |
| 3,429,280 | 2/1969 | Dashew et al. | 105/30 |
| 3,518,947 | 7/1970 | Borst | 105/30 |
| 3,648,617 | 3/1972 | Metzner et al. | 105/30 |
| 3,698,326 | 10/1972 | Schurch et al. | 104/93 |
| 3,774,548 | 11/1973 | Borst | 105/30 |
| 3,854,419 | 12/1074 | Cocroft | 104/93 |
| 3,935,822 | 2/1976 | Kaufmann | 104/93 |
| 4,015,537 | 4/1977 | Graef et al. | 104/91 |
| 4,044,688 | 8/1977 | Kita | 105/30 |
| 4,171,670 | 10/1979 | Roberts | 104/93 |
| 4,794,865 | 1/1989 | Lindberg | 105/30 X |

FOREIGN PATENT DOCUMENTS 2242277 3/1975 France .

*Primary Examiner*—Robert J. Oberleitner
*Assistant Examiner*—S. Joseph Morano
*Attorney, Agent, or Firm*—Ernest A. Beutler

[57] ABSTRACT

A freight system comprising a conveyor adapted to be driven along a monorail track. A frictional drive wheel of the conveyor engages the upper side of the track and various embodiments of reactive force creating means are positioned to engage the underside of the track to create improved frictional forces during ascendancy. All of these embodiments employ the weight of the unit to create the reactional force and in all embodiments there are positioned a pair of spaced apart guide rollers that engage the underside of the track. In some embodiments, these guides rollers are resiliently biased by either separate springs or by making the guide rollers themselves resilient. In some embodiments there is provided an intermediate fixed guide roller to limit the degree of relative movement between the conveyor and the track. In one embodiment, the guide rollers are suspended by a Y shaped lever that itself carries the load transmitted by the conveyor.

18 Claims, 11 Drawing Sheets

OVERHEAD CONVEYOR WHICH PROVIDES INCREASED REACTIVE FORCE AND TRACTION TO DRIVE WHEEL ON ASCENDING RAIL SECTIONS

BACKGROUND OF THE INVENTION

This invention relates to a freight system and more particularly to an improved conveying system that is adapted to travel over a path that includes ascending and descending sections.

Conveyors are employed for a wide variety of purposes. For example, conveyors are frequently used in various manufacturing plants to convey parts between various work stations. In order to obtain maximum utility of the work area, frequently the work stations may be located at different levels. It is convenient if a single conveying system can be utilized for transferring the work between all of the various levels and the work stations located there.

One popular type of conveyor system is the monorail type system. With such a monorail conveyor, the conveyor operates about a path defined by a single guide rail and thus the conveyor can be quite simpler than other types of conveyor systems and also can be located in a wider variety of locations. Frequently such conveyors are driven by means of a drive roller or gear that is engaged with the track for moving the conveyor along the track. However, when the conveyor must go up an ascending section, there becomes considerable difficulties in driving it along such a track. Frequently, it has been proposed to employ some kind of positive drive system that will permit the ascendancy of the conveyor along the track. However, said systems are complicated and expensive.

It is, therefore, a principal object of this invention to provide an improved conveyor system of the monorail type.

It is a further object of this invention to provide a monorail type conveyor that can be employed for conveying articles along a path that has both ascending and descending sections.

It is a further object of this invention to provide an improved arrangement for driving a monorail conveyor wherein a frictional drive can be employed even during ascendancy of the conveyor.

SUMMARY OF THE INVENTION

This invention is adapted to be embodied in a monorail type conveyor adapted to convey articles along a path defined by a guide rail. The conveyor includes a drive mechanism that is supported on the guide rail and which has a frictional drive wheel engaged with the guide rail. The guide rail is formed with at least an ascending section and means are provided for increasing the reaction force of the drive wheel along the track surface when travelling along the ascending surface.

DETAILED DESCRIPTION OF THE PREFERRED EMBODIMENTS

Figure 1:
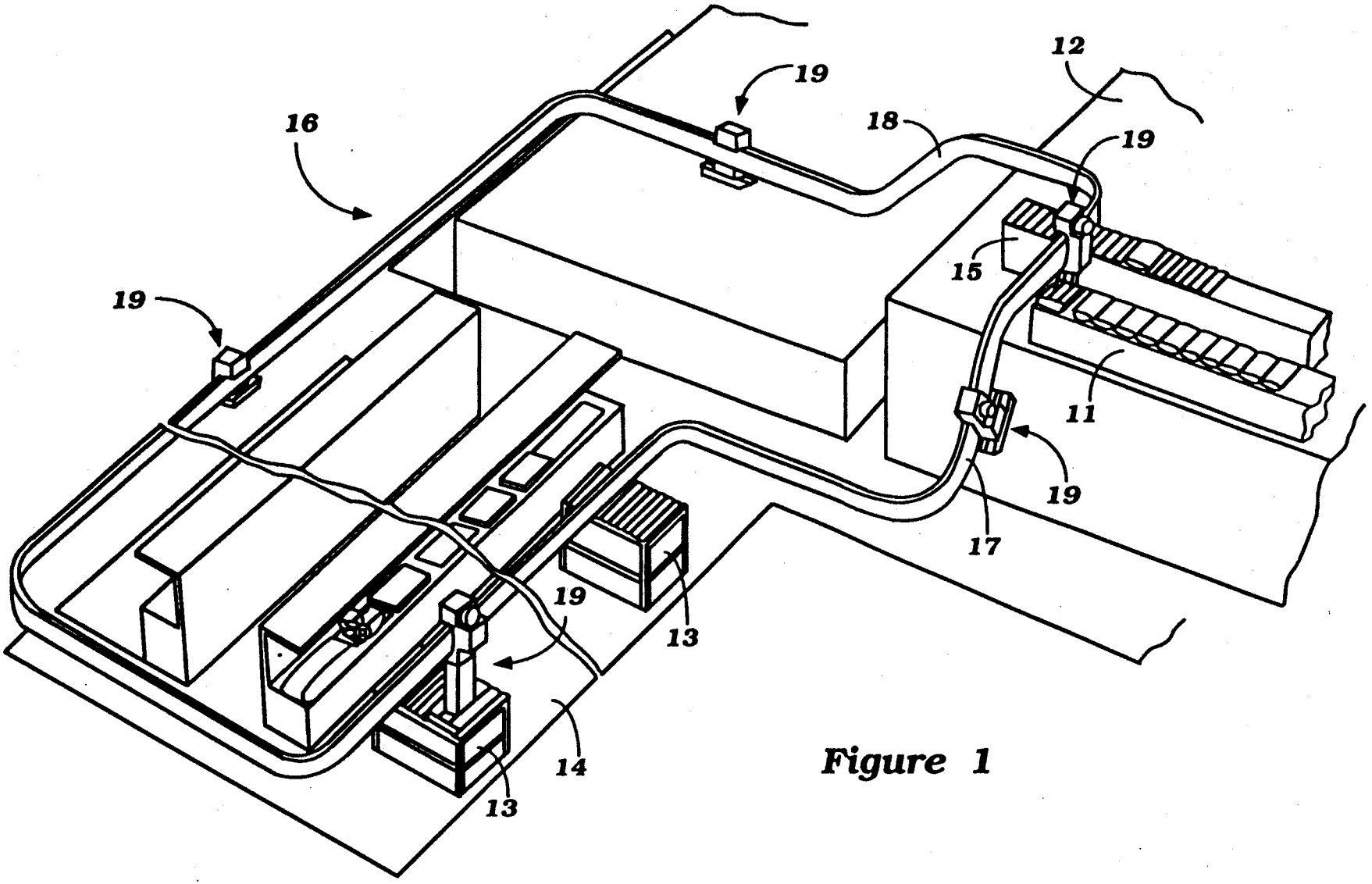
FIG. 1 is a perspective view showing a plant incorporating a conveyor system constructed in accordance with an embodiment of the invention.

Referring first to FIG. 1, there is depicted generally a plant, such as an automotive engine assembly line, having a conveyor system that is constructed in accordance with an embodiment of the invention and which is adapted to deliver work pieces to a delivery conveyor 11 that is positioned in a raised area 12 of the plant and from parts bins 13 positioned at a lower level 14 in the plant. Alternatively, the device may pick up work pieces at a higher area and lower them to a lower work area or may move them between various areas depending upon the particular orientation of the plant. Empty work piece holding buckets are delivered to a transfer conveyor 15.

Figure 2:
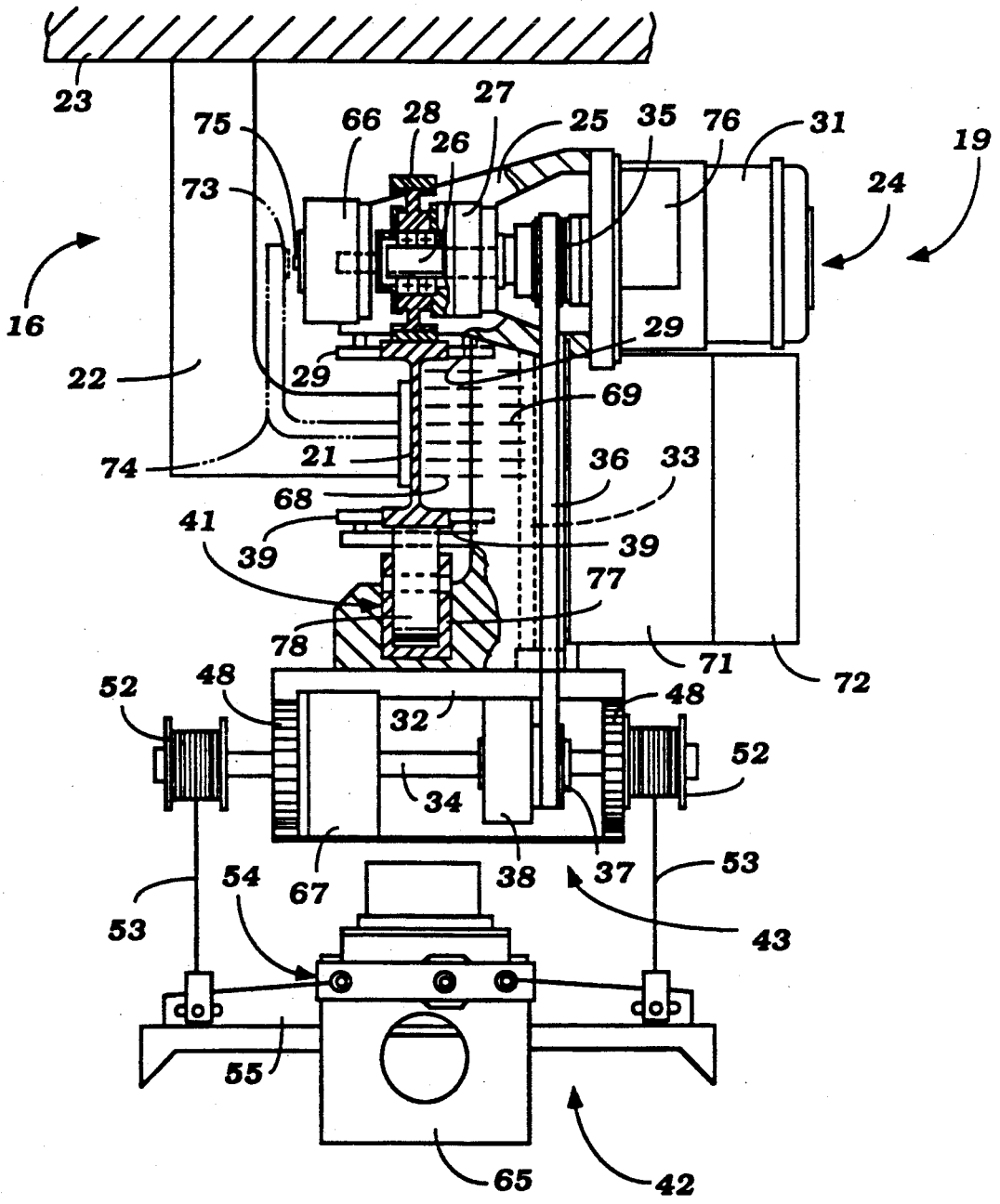
FIG. 2 is an enlarged end elevational view of the conveyor mechanism, with a portion broken away and shown in section.
Figure 3:
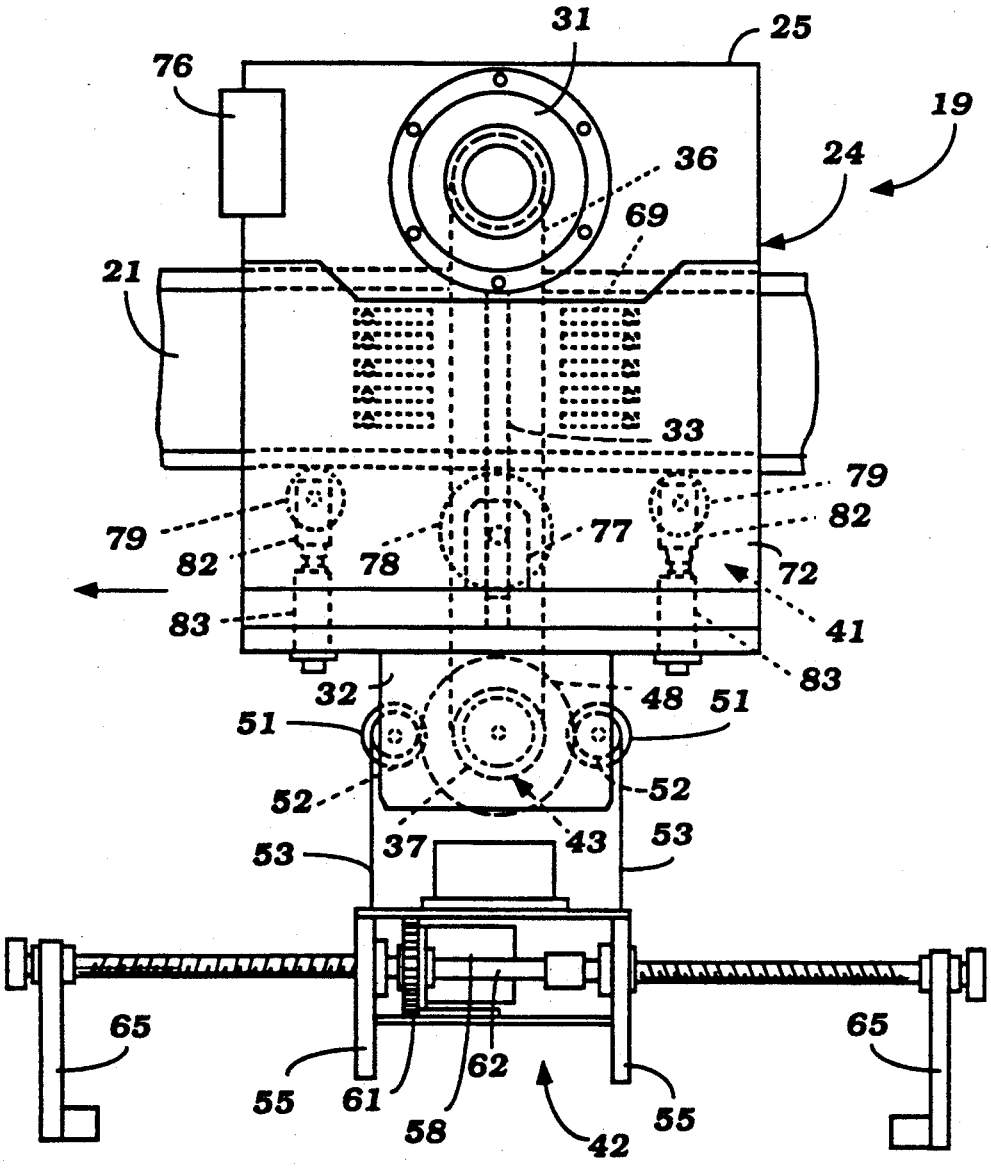
FIG. 3 is a side elevational view thereof.
Figure 4:
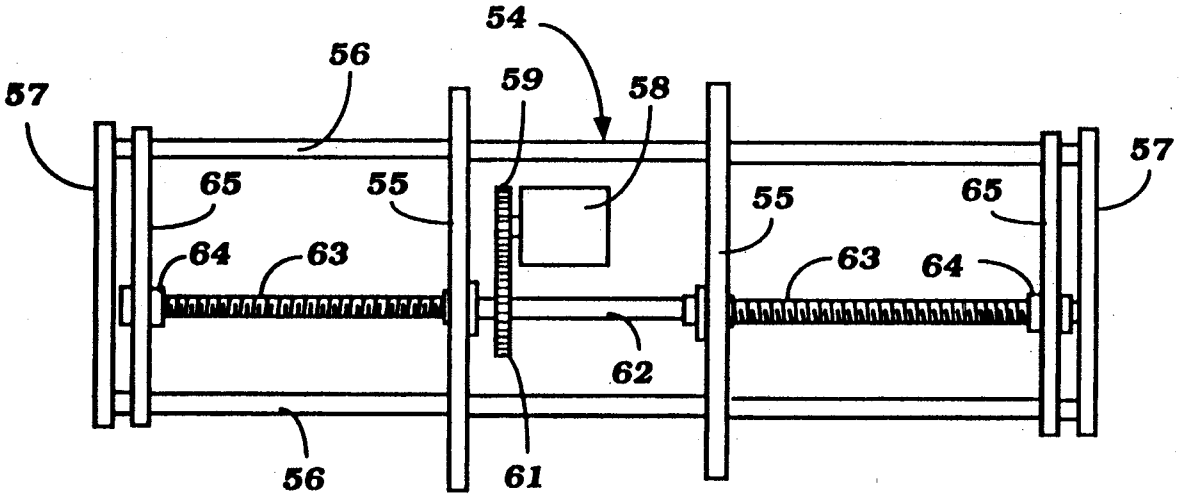
FIG. 4 is a top plan view of the work piece gripping unit.

The conveyor system includes a mono- or guide rail, indicated generally by the reference numeral 16 and having a construction as will be described. The monorail 16 has a ascending portion 17 running to the raised area 12 from the floor 14 and a descending section 18 running in the opposite direction. A plurality of conveyor assemblies 19 are supported along the rail 16 for conveying the work pieces in the desired path and making stops at the appropriate stations. The conveyor mechanisms 19 will be described in most detail by reference to the remaining figures and first particularly to the embodiment shown in FIGS. 2 through 4.

The monorail 16 is comprised primarily of an I beam 21 having a generally vertically extending web and horizontally extending flanges. The I beam 21 is supported by means of a plurality of L shaped brackets 22 from a roof 23. As has been previously noted, the configuration of the guide rail assembly 16 is such that the I beam 21 will have raised and lowered areas and also curved areas. Of course, the invention can be utilized in conjunction with conveyors wherein the rail is always positioned at the same elevation, but the invention has particular utility in conjunction with arrangements wherein the rail has elevating and lowering sections.

The conveyor 19 includes a supporting and driving conveyor, indicated generally by the reference numeral 24 that is comprised of a frame having an upper portion 25 that journals a driving shaft 26 in an appropriate member. The driving shaft 26 is driven in a manner to be described and is adapted to be drivingly coupled by means of an electrically operated clutch 27 to a rubber or other high friction material tired drive wheel 28 that is engaged with the upper surface of the upper flange of the I beam 21. Obviously, as the wheel 28 is rotated, the conveyor 19 will traverse along the path defined by the I beam 21.

An electric motor 31 is supported by the frame assembly 25 and drives the shaft 26. The electric motor 31 is a high torque, low speed direct drive motor and is powered in a manner to be described.

A lower frame assembly 32 is supported from the frame assembly 25 by means of at least one L shaped bracket 33. A shaft 34 is journaled by the lower frame assembly 32 and is driven from the electric motor 31 by means of a transmission including a pulley 35 that is affixed for rotation with the motor shaft 26. The pulley 35 drives a belt 36 which, in turn, drives a belt 37. The belt 37 is coupled to the shaft 34 by means of an electrically operated clutch 38.

A pair of lower guide rollers 39 engage the opposite sides of the lower web of the I beam 21 so as to add further stability. The rollers 39 are freely journaled on the lower frame assembly 32. A friction generating assembly 41 is associated with the lower frame assembly 32 and coacts with the underside of the lower flange of the I beam 21 so as to increase the friction of the drive roller 28 when travelling up grades so as to improve its frictional drive and to avoid the necessity of using positive drive gears. This structure will be described later by more reference to FIG. 5.

A gripping unit, indicated generally by the reference numeral 42 is suspended from the frame assembly 32 and is movable vertically relative to it by means of a combined drive and suspension unit, indicated generally by the reference numeral 43. The unit 43 includes the driving shaft 34 which, as has been noted, is driven from the motor shaft 26 by means of a belt 36 and an electric clutch 38 so as to selectively actuate the shaft 34 and raise and lower the gripping unit 42 through substantial height variations in the manner now to be described.

A pair of gears 48 are affixed to the opposite ends of the shaft 34 and are each enmeshed with a pair of diametrically opposed driven gears 51. The gears 51 are affixed to shafts upon which drums 52 are fixed. The drums 52 have wound on them respective lengths of cable 53 that are connected to a frame assembly 54 of the work piece gripping unit 42.

The frame assembly 54 includes a pair of cross bars 55 that are connected to perpendicularly extending plates 56 which are capped at their opposite ends by end plates 57.

An electric motor 58 is carried by the frame assembly 54 and drives a driving gear 59. The driving gear 59 is enmeshed with a driven gear 61 that is fixed to a feed shaft 62. The feed shaft 62 is journaled on the frame assembly by the plates 55 and 57 and has a pair of threaded portions 63 of opposite hand. The threaded portions 63 are received in feed nuts 64 that are affixed to gripping plates 65. Operation of the motor 58, which is a reversible motor, will cause the gripping plates 65 to move toward or away from each other between a spaced position as shown in the figures and a gripping position wherein a work piece may be gripped therebetween.

An electrically operated brake 66 is associated with the drive wheel 28 and selectively locks the conveyor 19 in position on the guide rail 21 at times as will be described. In a like manner, an electric brake 67 is associated with the shaft 34 for locking this shaft and the gripping mechanism 42 in its vertically disposed positions. Electric power for the motors 31 and 58, the electrically operated clutches 27 and 38 and the electrically operated brakes 66 and 67 are provided by a plurality of power rails 68 that are positioned along the web of the I beam 21 and are engaged by wipers 69 carried by the frame assembly 25. These wipers 69 deliver the power to a power box 71 which, in turn, is connected to a control box 72 so as to control the various electrical components.

There is also provided at spaced locations along the guide rail 21 position indicators 73 that are carried by angle brackets 74 and which cooperate with a sensor 75 so as to provide signals to the control device 72 when the conveyor 19 is at certain positions on the guide rail 16, such as at the stations 11, 13 and 15.

The control mechanism 72 may include a preprogrammed control that will provide the desired sequence of operations, a typical one of which will be hereinafter described. It should be understood, however, that those skilled in the art can readily adapt the control sequences to specific applications.

When the conveyor 19 is at a station indicated by the position indicator 73, normally the clutches 27 and 38 will be disengaged and the brakes 66 and 67 engaged. If it is desired to raise or lower the work piece, the brake 67 is released and the clutch 38 is engaged while the brake 66 remains engaged. The gripping device 42 may then be raised or lowered to the appropriate position and the motor 58 energized so as to either grip or release a work piece.

After the work piece is released or gripped, the gripping device 42 may be again raised or lowered as desired and then the clutch 46 is released and the brake 67 is engaged so as to lock the gripping device 42 at the desired height.

When the conveyor 19 is ready to be moved to the next station, the brake 66 is released and the clutch 27 is engaged so that the conveyor can move to the next station as determined by the position indicator 73 and sensor 75. Again, the gripping device 42 may be raised or lowered and either grip or release a work piece. It is believed from this description that those skilled in the art will readily understand how the conveyor mechanism described can be utilized for any of a wide variety of purposes and in a wide variety of applications. There is further provided an obstruction indicator 76 that is carried by the frame 25 of the conveyor and which will sense if an obstacle is positioned in front of the conveyor 19 and this will effect operation of the brakes 66 and 67 and release of the clutches 27 and 46 until the obstacle has been cleared.

As has been previously noted, the conveyor 19 must move up an ascending portion 17 of the guide rail 16. When this occurs with conventional types of conveyors, the frictional engagement between the wheel 28 and the upper flange of the I beam 21 will be decreased and slippage can occur. As has been previously noted, the friction generating mechanism 41 creates a reactive force on the lower side of the lower flange of the I beam 21 so as to increase the frictional force. This construction and its operation may be best understood by reference to FIG. 5.

Figure 5:
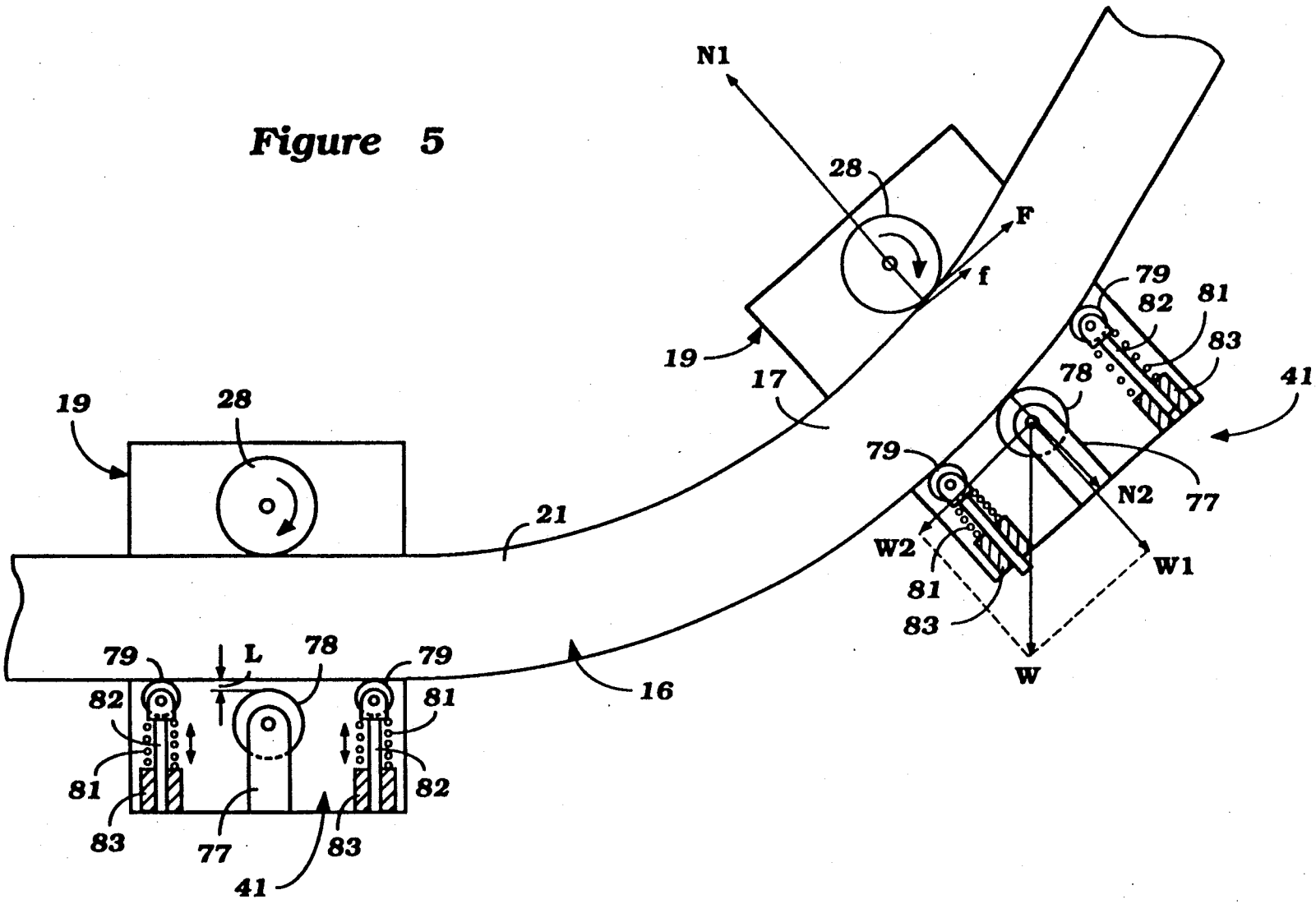
FIG. 5 is a side elevational view and vector analysis showing how the device works to increase the traction during ascendancy.

As shown in FIG. 5, the lower frame 32 has a centralized support bracket 77 that rotatably journals a guide roller 78. When the conveyor 19 is travelling in a horizontal plane, the roller 78 will be spaced from the underside of the lower flange of the rail 16 by a distance L.

This spacing is maintained by means of a pair of further rollers 79 that are urged by coiled compression springs 81 upwardly into engagement with the underside of the lower I beam flange. The rollers 79 are carried by supporting shafts 82 that are circled by the springs 81 and which are journaled within blocks 83 of the frame 32. As may be seen in the left hand side view of FIG. 5, when the device is operating on a horizontal plane, there will be a certain preload in the springs 81 that maintain some degree of frictional engagement.

As the conveyor 19 begins to climb the elevated section 17, the unit will tend to shift due to its center of gravity and the inclined shape. The degree of pivotal movement will be limited by the engagement of the roller 78 with the underside of the flange of the I beam 21 and the weight W of the conveyor will be broken down into a pair of vectors W2 acting parallel to the face of the lower flange and a vector W1 acting perpendicularly to it. This generates a resulting force N2 that creates a reactive force with the wheel 28 N1 in the direction for pressing the drive wheel against the upper flange of the I beam 21 so that the driving force F is much greater than the force f that would occur had not this reactive mechanism been employed. Because of this added frictional force, a substantially improved driving arrangement can be employed and it is not necessary to incorporate gear or other types of positive drives.

Figure 6:
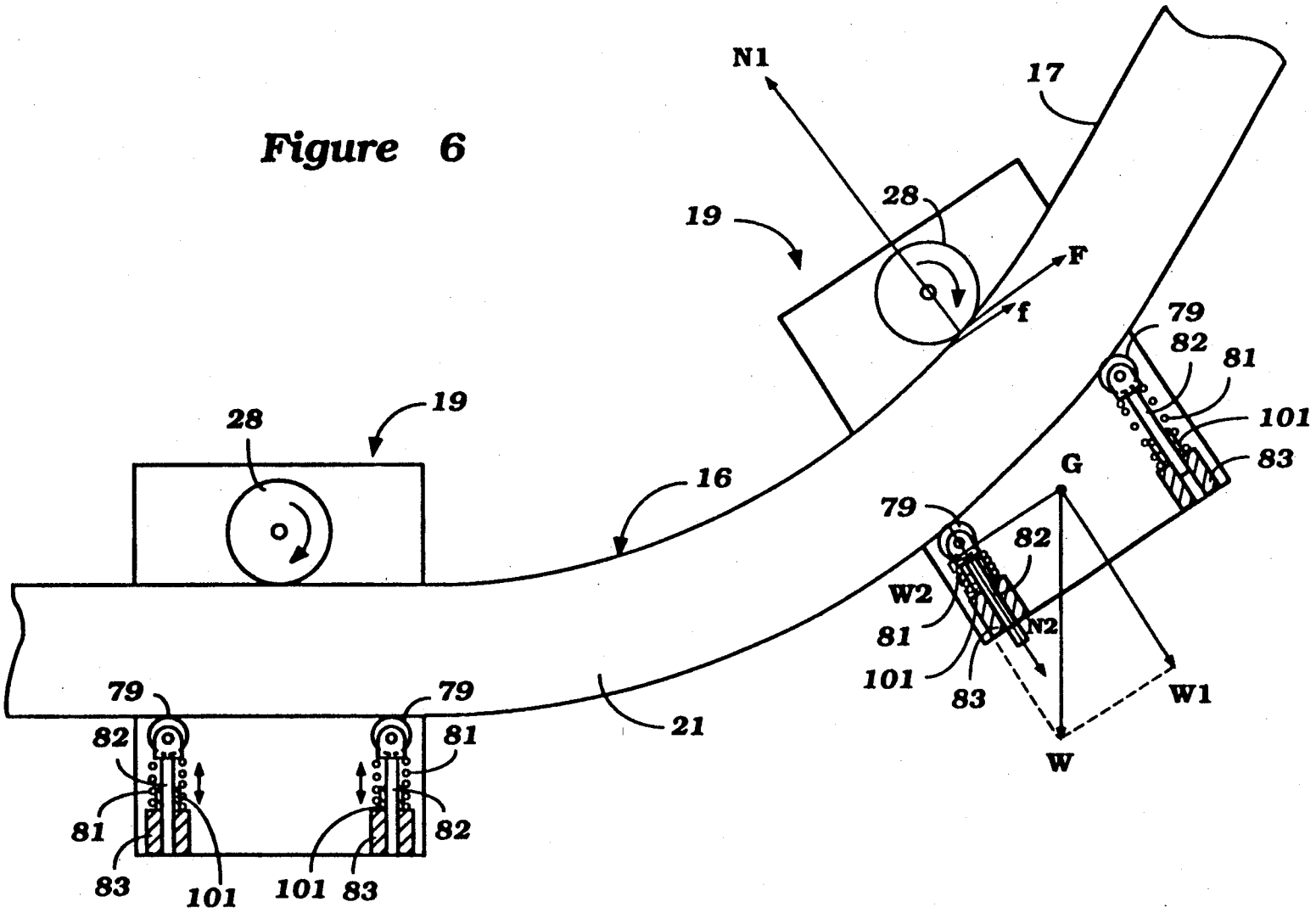
FIG. 6 is a side elevational view, in part similar to FIG. 5, showing another embodiment of the invention.

FIG. 6 shows another embodiment of the invention which is generally the same as the embodiment of FIGS. 1 through 5. In this embodiment, however, the roller 78 and its support 77 are eliminated. In order to limit the degree of pivotal movement, there are provided a pair of stopper blocks 101 which are encircled by the coil compression springs 81 and engaged by the support blocks 83. As may be seen in the right hand side view of this figure, after a predetermined pivotal movement has occured, the stopper block 101 associated with one of the guide rollers 79 will limit its degree of movement and the degree of compression of the coil spring 81 and the aforenoted reactive forces will be created.

Figure 7:
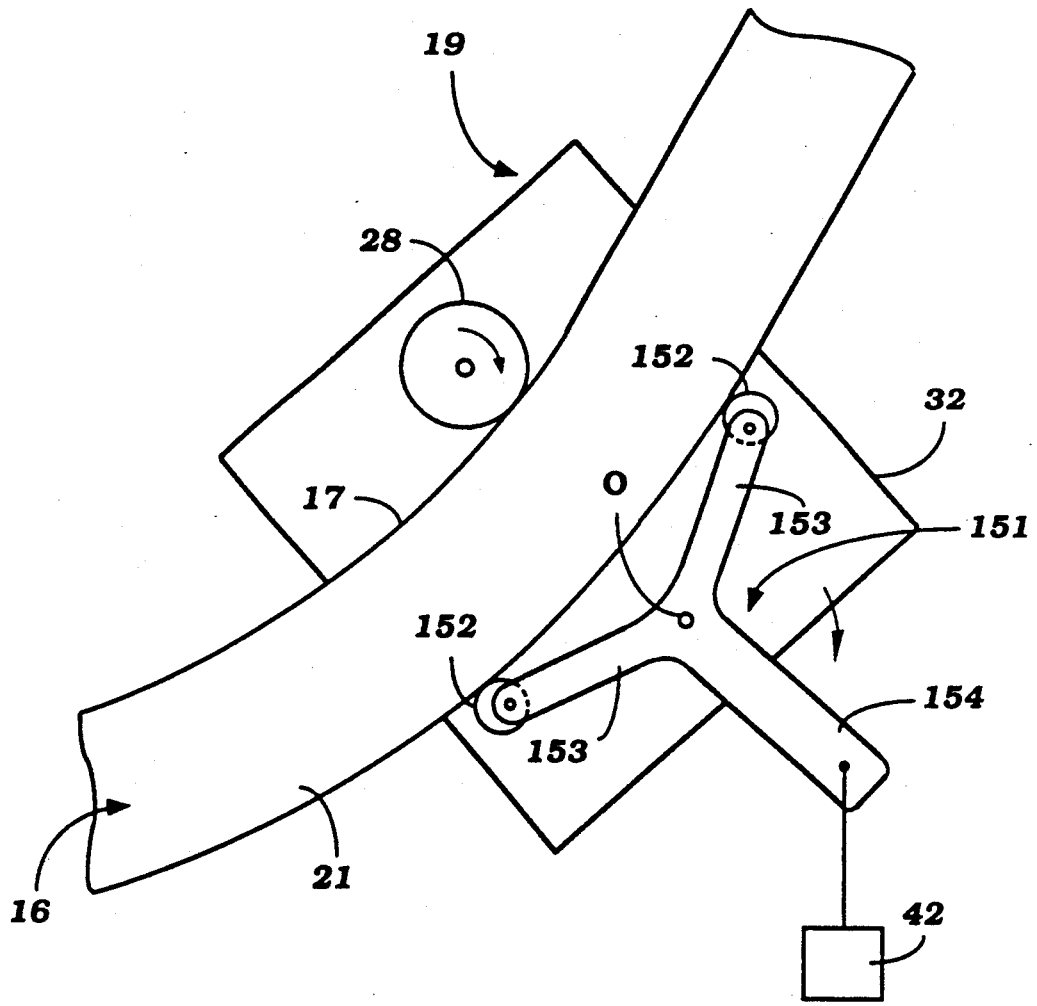
FIG. 7 is a side elevational view, in part similar to FIGS. 5 and 6, showing a still further embodiment of the invention.
Figure 8:
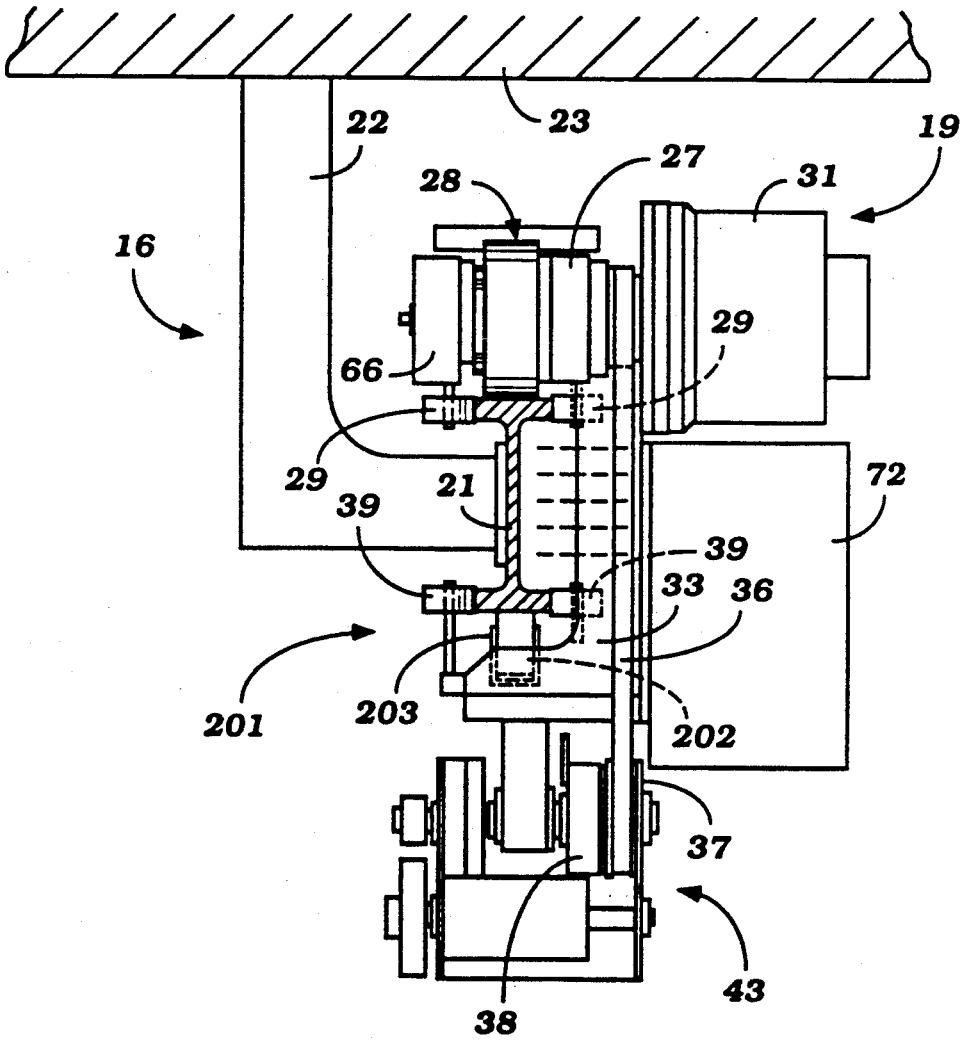
FIG. 8 is an enlarged end elevational view, in part similar to FIG. 2, and shows another embodiment of the invention.
Figure 9:
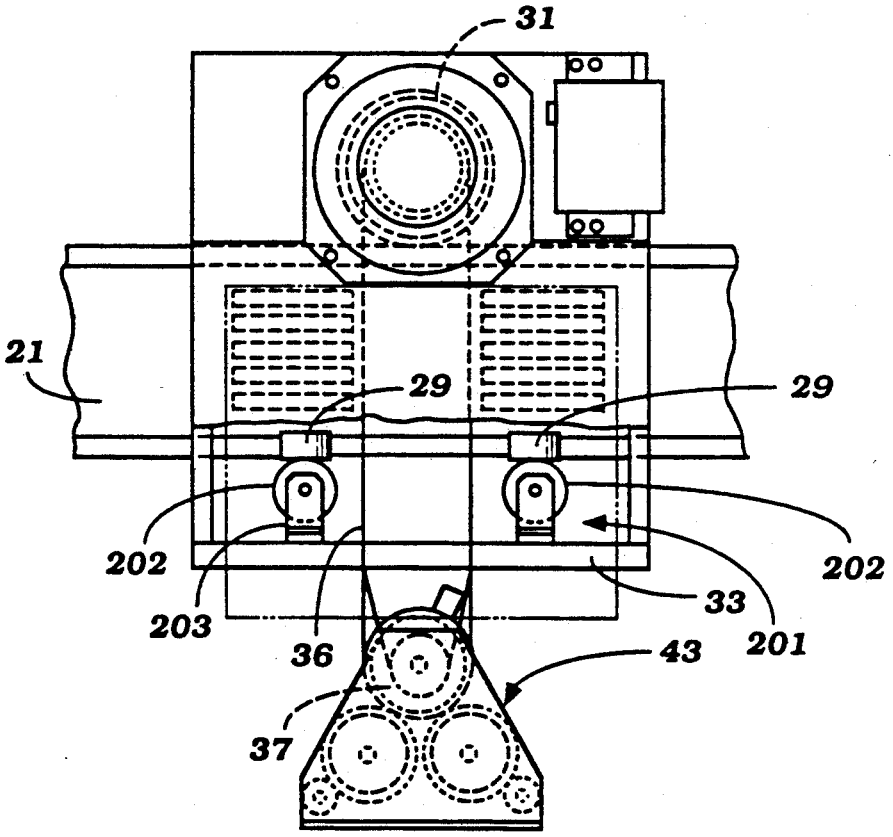
FIG. 9 is a side elevational view of this embodiment.
Figure 10:
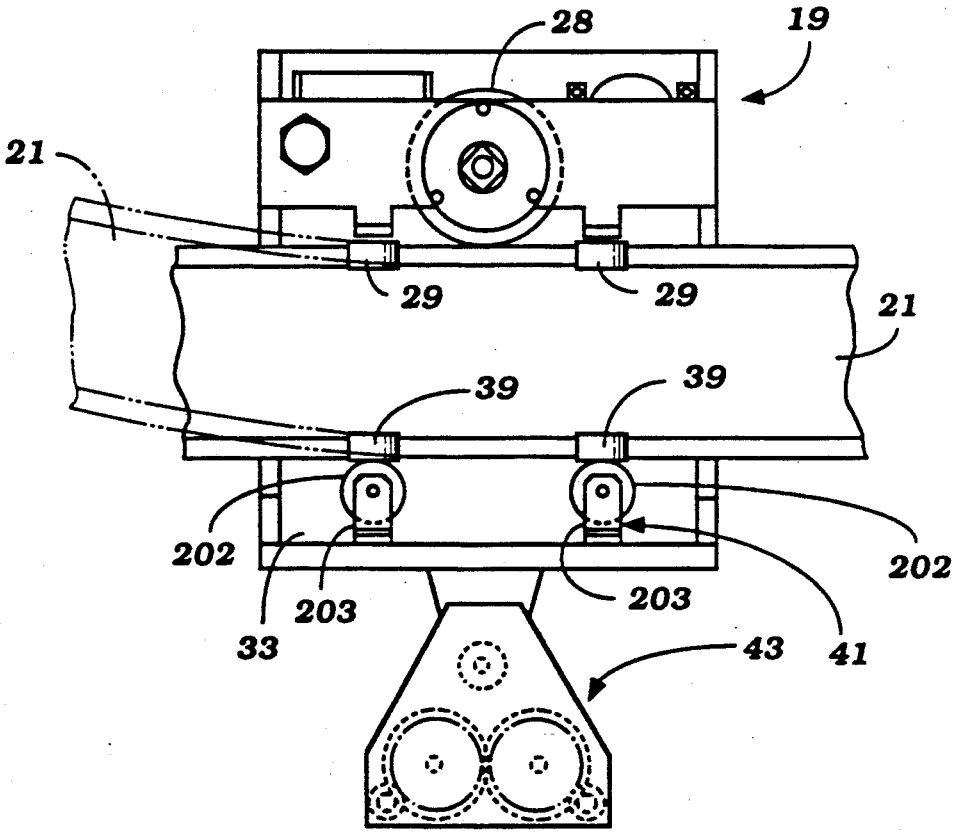
FIG. 10 is a view looking from the side opposite FIG. 9.

FIG. 7 shows another embodiment of the invention which eliminates the necessity for employing springs. In this embodiment, the gripping mechanism 42 is suspended from the lower frame 32 by means of a Y shaped lever arm 151 that is pivotally supported on the frame 32 about a pivot point O. A pair of rollers 152 are carried at opposite ends of angularly diverging arms 153 of the lever arm 151. The remaining arm 154 of the lever 151 carries the weight of the gripping unit 42 and any parts carried by it. As a result, when the device moves up an incline as shown in this figure, the weight of the gripping device 42 and any parts carried thereby will effect pivotal movement of the lever 151 so as to cause one of the rollers 152 to react against the lower surface of the lower flange of the I beam 21 and create the aforenoted magnified frictional forces.

FIGS. 8 through 11 show yet another embodiment of the invention. This embodiment is similar to the previously described embodiments but employs a frictional force increasing mechanism 201 which employs a pair of spaced apart resilient guide wheels 202 that are journaled on the lower frame 32 by means of supporting brackets 203. The wheels 202 are formed from an elastomeric material that has some degree of initial resilience so as to permit pivotal movement as with the embodiments of FIGS. 1 through 5, 6 and 7. However, as is typical with elastomeric materials, the resilient resistance increases and at a certain point will act more rigidly so as to achieve the same results as employing non linear springs. Because of this similarity to the previously described embodiments in the principle of operation, further description of this embodiment is not believed to be necessary.

Figure 11:
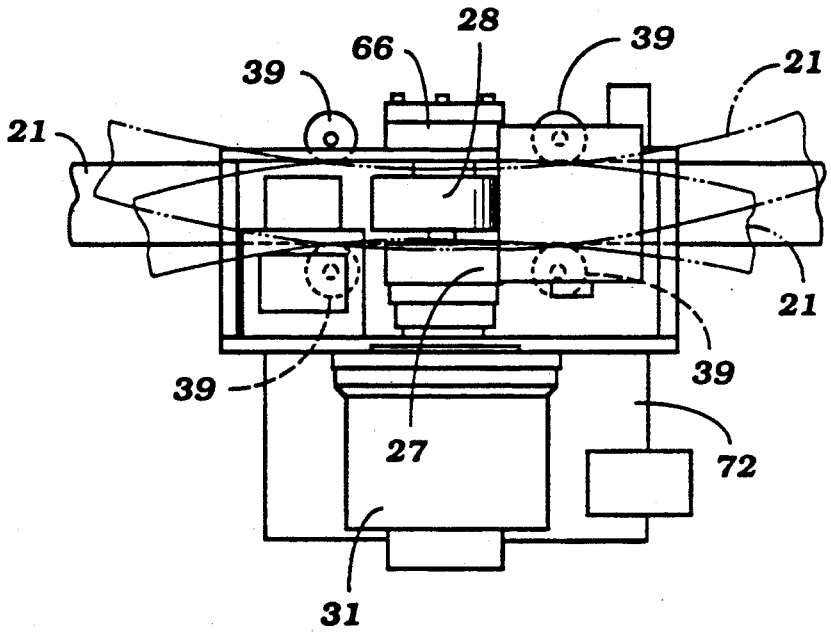
FIG. 11 is a top plan view.

It should be noted that FIG. 11 shows how the rollers 29 and 39 assist in the tracking along the I beam 21 when curves are being rounded.

It should be readily apparent that the described embodiments of the invention are particularly adapted at insuring good frictional drive even when ascending a steeply inclined portion of the guide rail 16. Although a number of embodiments of the invention have been illustrated and described, various changes and modifications may be made without departing from the spirit and scope of the invention, as defined by the appended claims.

We claim:

1. A conveyor mechanism comprised of a guide rail defining a path along which articles are to be conveyed, a drive mechanism supported on said guide rail and having a frictional drive wheel engaged with said guide rail, said drive wheel and said guide rail having a constant cross-sectional area of engagement along said path, said guide rail being formed with at least an ascending section extending upwardly from a horizontal section, and means for providing an increased reactive force of said drive wheel along said path only when traveling along said ascending section.

2. A conveyor mechanism as set forth in claim 1 wherein the frictional drive wheel engages the upper side of the track.

3. A conveyor mechanism as set forth in claim 2 wherein the means for providing an increased reaction force comprises means cooperating with the underside of the track.

4. A conveyor mechanism as set forth in claim 3 wherein the means cooperating with the underside of the track comprises at least one first guide roller engaged with the underside of the track.

5. A conveyor mechanism as set forth in claim 4 wherein the first guide roller is resiliently biased into engagement with the track.

6. A conveyor mechanism as set forth in claim 5 wherein the resilient biasing of the first guide roller comprises spring means.

7. A conveyor mechanism as set forth in claim 5 wherein the first guide roller is itself resilient to provide the biasing force.

8. A conveyor mechanism as set forth in claim 4 wherein there are a pair of longitudinally spaced first guide rollers, each engaged with the underside of the track and each resiliently biased.

9. A conveyor mechanism as set forth in claim 8 wherein the resilient biasing of the first guide rollers comprises spring means.

10. A conveyor mechanism as set forth in claim 8 wherein the first guide rollers themselves are resilient to provide the biasing force.

11. A conveyor mechanism as set forth in claim 8 further including a fixed guide roller disposed on the upper side of the track and positioned between the first guide rollers.

12. A conveyor mechanism as set forth in claim 11 wherein the fixed guide roller is supported for rotation about a fixed axis.

13. A conveyor mechanism as set forth in claim 12 wherein the fixed guide roller is not engaged with the track when the conveyor is travelling in a horizontal plane.

14. A conveyor mechanism as set forth in claim 13 wherein the resilient biasing of the first guide rollers comprises spring means.

15. A conveyor mechanism as set forth in claim 13 wherein the first guide rollers themselves are resilient to provide the biasing force.

16. A conveyor mechanism as set forth in claim 4 wherein there are a pair of first guide rollers engaged with the underside of the track.

17. A conveyor mechanism as set forth in claim 16 wherein the pair of first guide rollers are supported by a pivotally supported lever mechanism and further including gravity biasing means for urging the lever mechanism to increase the pressure of one of the first guide rollers when the ascending section of the track is being traversed.

18. A conveyor mechanism as set forth in claim 17 wherein the gravity is generated by the weight of the article being conveyed.

* * * * *